US008702270B2

(12) United States Patent
Wu

(10) Patent No.: US 8,702,270 B2
(45) Date of Patent: Apr. 22, 2014

(54) TUBE TYPE LED LIGHTING ASSEMBLY

(75) Inventor: Bor-Jen Wu, New Taipei (TW)

(73) Assignee: Nan Ya Photonics Inc., New Taipei (TW)

( * ) Notice: Subject to any disclaimer, the term of this patent is extended or adjusted under 35 U.S.C. 154(b) by 88 days.

(21) Appl. No.: 13/465,317

(22) Filed: May 7, 2012

(65) Prior Publication Data

US 2013/0182407 A1 Jul. 18, 2013

(30) Foreign Application Priority Data

Jan. 17, 2012 (TW) ..... 101101729 A

(51) Int. Cl.
*F21V 1/00* (2006.01)

(52) U.S. Cl.
USPC ..... 362/235; 362/217.01; 362/217.05; 362/217.07

(58) Field of Classification Search
USPC ..... 362/84, 235, 217.01, 219, 217.07, 225, 362/217.05, 217.06, 223
See application file for complete search history.

(56) References Cited

U.S. PATENT DOCUMENTS

| | | | | |
|---|---|---|---|---|
| 6,682,211 | B2 * | 1/2004 | English et al. | 362/545 |
| 7,048,412 | B2 * | 5/2006 | Martin et al. | 362/247 |
| 8,449,137 | B2 * | 5/2013 | Dassanayake et al. | 362/217.06 |
| 8,475,021 | B2 * | 7/2013 | Iwasaki et al. | 362/519 |
| 2011/0255277 | A1 * | 10/2011 | Dassanayake et al. | 362/217.06 |

* cited by examiner

*Primary Examiner* — John A Ward
(74) *Attorney, Agent, or Firm* — Guice Patents PLLC

(57) ABSTRACT

An LED lighting assembly includes a concave reflector, a supporter located in a central region of the concave reflector, and multiple LEDs mounted on the supporter. The supporter has a first face and a second face, and an angle is formed between the first face and the second face.

8 Claims, 6 Drawing Sheets

TUBE TYPE LED LIGHTING ASSEMBLY

BACKGROUND OF THE INVENTION

1. Field of the Invention

The present invention relates to LED lighting assemblies, especially to LED lighting assemblies capable of replacing fluorescent tubes.

2. Description of the Related Art

Lighting is important to our daily life, and after Edison invented the light bulb, we have been using lighting assemblies day and night. Current lighting assemblies mainly include incandescent light bulbs, fluorescent tubes, and compact fluorescent lamps. Compact fluorescent lamps are used to replace incandescent light bulbs to provide compatible luminance in same operation manner. Fluorescent tubes are popularly used in offices or public places of large area.

For the present, environmental protection issues of power saving, low carbon consumption, and products without mercury are highly concerned, and LEDs (light emitting diodes) happen to meet the mentioned requirements. Besides, as LEDs are solid state devices, unlike traditional fluorescent tubes made of fragile glass, therefore they are far more convenient for transportation than traditional fluorescent tubes. In addition, LEDs have the advantages of small size and directional lighting, so they are suitable to be applied in lighting applications requiring small size or directional lighting, and are therefore becoming the main choice of next generation lighting in replacing traditional fluorescent tubes.

Please refer to FIG. 1, which illustrates a cross sectional view of a prior art LED lighting assembly. As illustrated in FIG. 1, multiple LEDs 20 are mounted inside a housing 10 of a rectangular shape, and a light output face of the housing 10 is shielded by a lampshade 16. For the present, most LED lighting assemblies are designed in this way.

However, as the cross section of a lamp tube is of a curved shape, therefore some LED lighting assemblies are designed to be of tube type instead. Please refer to FIG. 2, which illustrates a cross sectional view of a prior art tube type LED lighting assembly. As illustrated in FIG. 2, multiple LEDs 20 are mounted inside a housing 12 of a half-tube shape, a transparent lampshade 18 of a half-tube shape connects with the housing 12 to form a lamp tube, and usually, a plate, as can be seen in the figure, is used in the housing 12 to mount the LEDs 20.

Although the small size of LEDs have the advantage of being capable of reducing the thickness of a lighting apparatus, however, the small size can also make the light intensity in a unit area so high as to result in a dazzling effect. To reduce the dazzling effect, one solution is to utilize a frosted lampshade to diffuse the light rays emitted from each LED. However, the intensity of output light will be attenuated accordingly. Besides, the light emitting efficiency of LEDs has been increasing per year as the manufacturing process keeps improving, and the increased light intensity has added challenges to the diffusion effect of the frosted lampshade. Under this circumstance, the frosted lampshade has to increase scattering effect to make the output light uniform, but this will further sacrifice the intensity of the output light.

In view of the mentioned problems, the present invention proposes a design to provide a superior LED lighting assembly, which is capable of reducing dazzling effect by using a lightly frosted lampshade, or even using no lampshade.

SUMMARY OF THE INVENTION

To attain the goals mentioned above, the present invention proposes an LED lighting assembly, which includes a concave reflector, a supporter located in a central region of the concave reflector, and two sets of LEDs.

The supporter has a first face and a second face, and an angle is formed between the first face and the second face. The two sets of LEDs are mounted on the first face and the second face for providing light to be reflected by the concave reflector to travel through a light output face.

To make it easier for our examiner to understand the objective of the invention, its structure, innovative features, and performance, we use preferred embodiments together with the accompanying drawings for the detailed description of the invention.

DETAILED DESCRIPTION OF THE PREFERRED EMBODIMENTS

The present invention uses a reflective way to output LED light instead of directly emitting LED light to prevent dazzling. Besides, as the light reflected by a selected material will be more uniform in the present invention, a transparent lampshade or a lightly frosted lampshade can be used instead of a heavily frosted lampshade to prevent output light attenuation.

Figure 3:
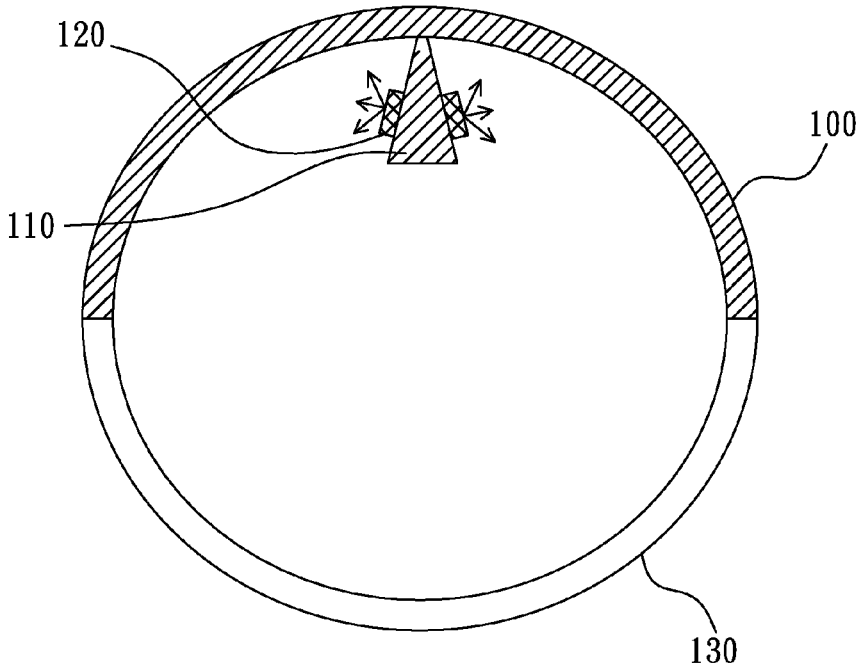
FIG. 3 illustrates a cross sectional view of a tube type LED lighting assembly according to a preferred embodiment of the present invention.

Please refer to FIG. 3, which illustrates a cross sectional view of an LED lighting assembly according to a preferred embodiment of the present invention, wherein the LED lighting assembly has a housing 100, which is a concave reflector, and a supporter 110, which is located in a center region of the concave reflector.

The supporter 110 has two faces with an angle between them, and two sets of LEDs 120 are mounted on the two faces of the supporter 110. Generally, the two sets of LEDs 120 are soldered on two printed circuit boards, and the two printed circuit boards are then mounted on the supporter 110.

The two sets of LEDs 120 provide light to be reflected by the housing 100 to travel downward through a light output face. The LEDs 120, depending on application requirements, can be of cold white light, or warm white light, or a combination of different light colors, or can go with a fluorescent powder to perform a light mixing. In FIG. 3, a lampshade 130 is used to connect with the housing 100 to form a lamp tube of a pillar shape, wherein the lampshade 130 can be transparent or lightly frosted.

The housing 100 can be made of aluminum, and a reflective film can be added inside; or made of plastics, and a reflective film is added inside. Either aluminum or plastics can make use of an extrusion process to form the housing 100—an extruded aluminum housing or an extruded plastic housing. Besides, the supporter 110 can share same material with the housing 100 and be integrated with the housing 100.

The lampshade 130 is usually implemented with transparent plastics, such as PMMA (polymethyl methacrylate), acryl, PE (polyethylene), or PC (Pots/carbonate). The lampshade can also be formed by using an extrusion process. Some micro structures can be introduced into the joints of the housing 100 and the lampshade 130 to improve the firmness of connection between them. Besides, a fastener can also be used to fasten the connection between the housing 100 and the lampshade 130.

Figure 1:
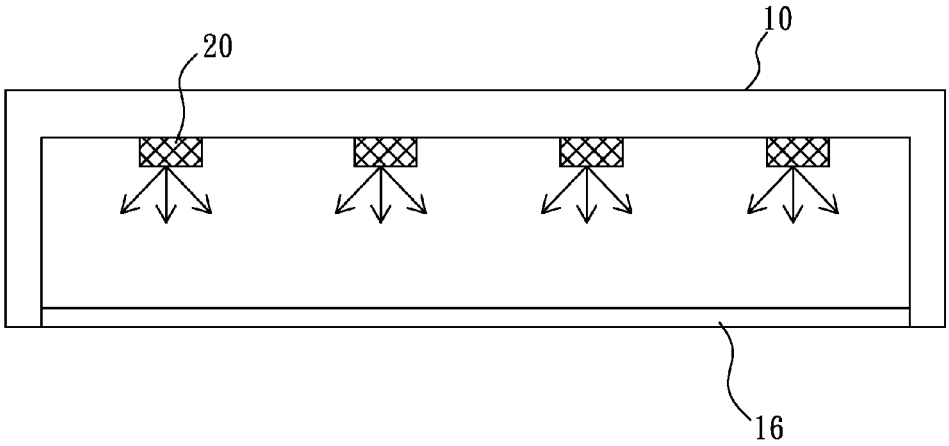
(PRIOR ART) FIG. 1
FIG. 1 illustrates a cross sectional view of a prior art LED lighting assembly.
Figure 2:
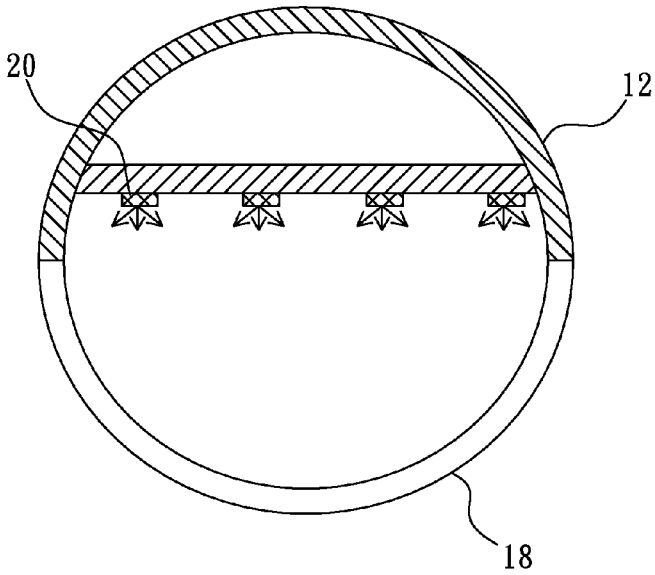
(PRIOR ART) FIG. 2
FIG. 2 illustrates a cross sectional view of a prior art tube type LED lighting assembly.
Figure 4:
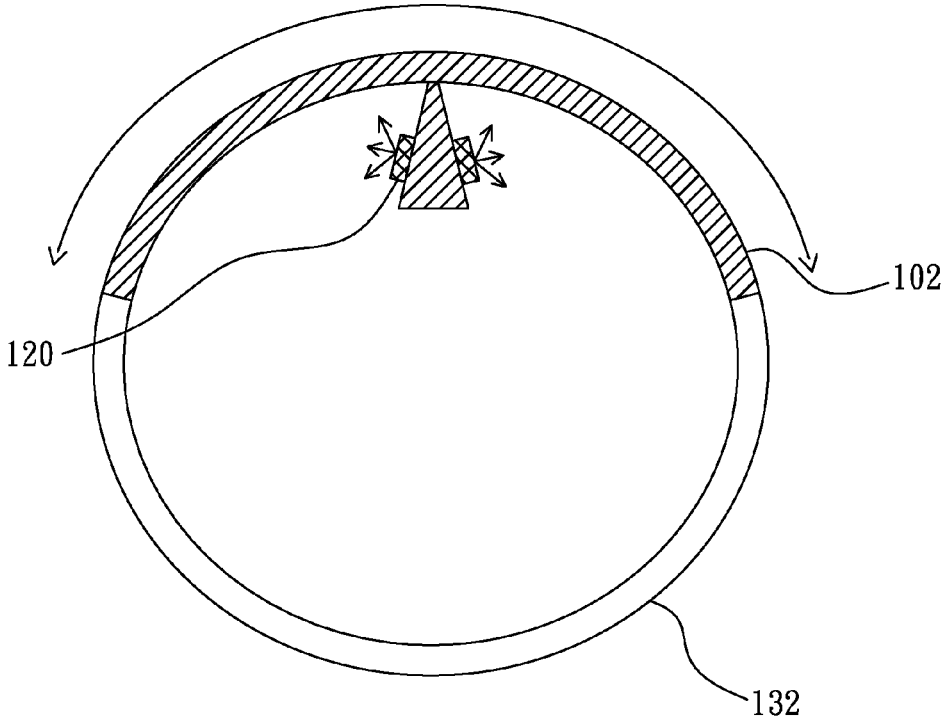
FIG. 4 illustrates a cross sectional view of a tube type LED lighting assembly according to another preferred embodiment of the present invention, wherein a housing of a less curved shape is used to provide more side light.

For some applications requiring not only illumination on area right below the lighting assembly but illumination on side areas, a housing 102 having a less curved shape as illustrated in FIG. 4—the cross-sectional shape of the housing 102 is an arc of 120 degrees for example—can be used. This design can increase side light of an LED lighting assembly. In comparison, the side light of the prior art LED lighting assembly of FIG. 2 is hard to increase even if the housing 102 of less curved shape is used in the lighting assembly of FIG. 2 due to a fact that, the light emitting faces of the LEDs of FIG. 2 are oriented downward and the LEDs possess directionality. However, as the present invention provides lighting through reflection, the increase of side light is much easier to attain.

Figure 5:
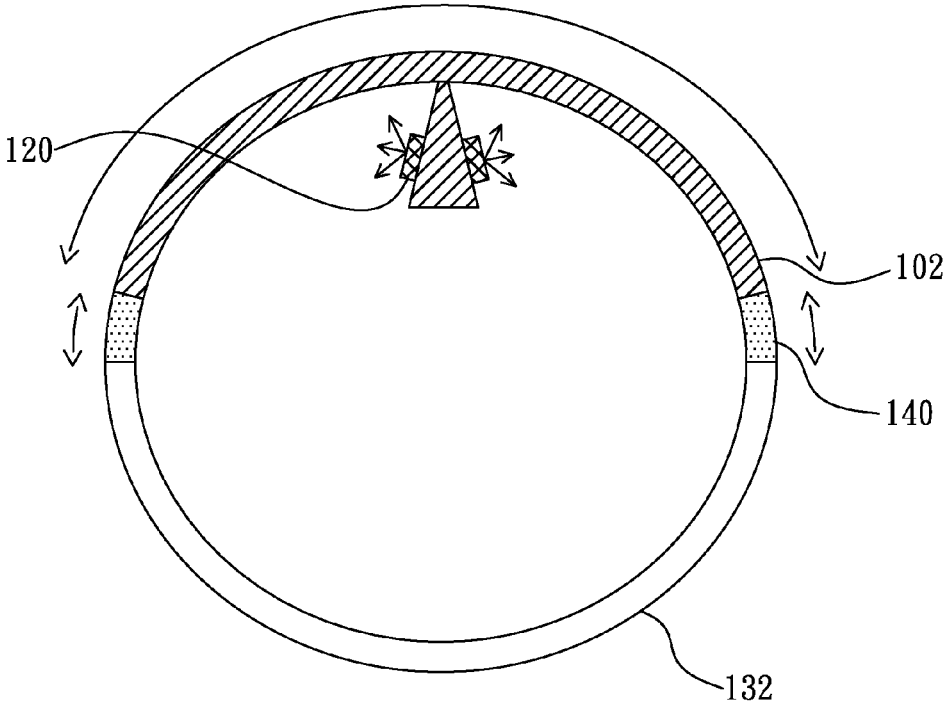
FIG. 5 illustrates a cross sectional view of a tube type LED lighting assembly according to another preferred embodiment of the present invention, wherein a lampshade having two frosted sections at two sides is used to prevent side light dazzling.

If the intensity of side light is to be moderate, two frosted sections 140, as illustrated in FIG. 5, can be implemented between the housing 102 and a lampshade 132 to attenuate side light. This structure, in which the two frosted sections 140 and the housing 102 combine to form a 180 degrees arc in cross section, is particular suitable for office illumination in that a couple of the tube type LED lighting assemblies of the present invention can be assembled to form a lighting apparatus to provide a planar light source. By this, not only area right below the lighting apparatus can be illuminated, but side areas more distant from the lighting apparatus can also get lighting.

Figure 6:
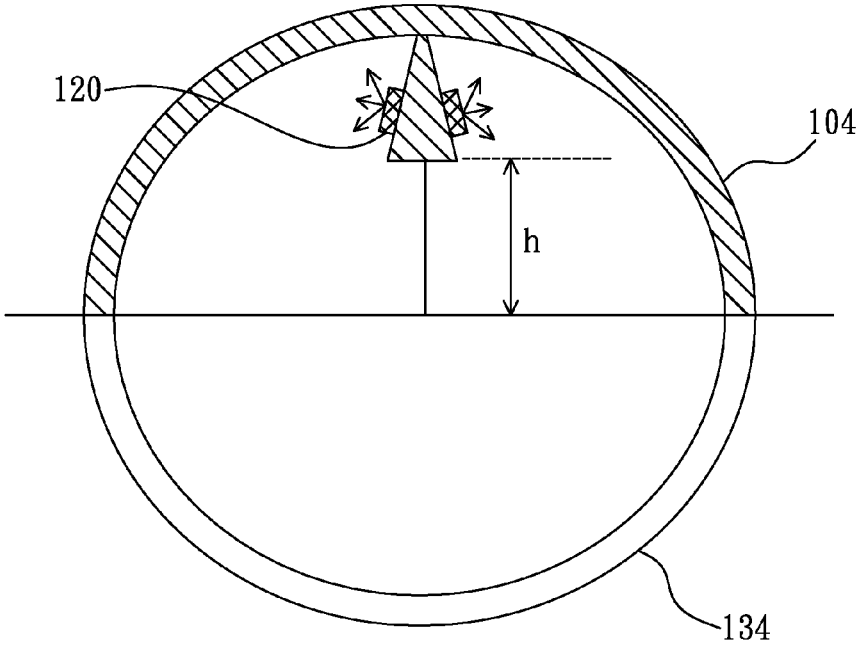
FIG. 6 illustrates a cross sectional view of a tube type LED lighting assembly according to another preferred embodiment of the present invention, wherein the tube type LED lighting assembly has a housing of a half-circle shape in cross-section.

Please refer to FIG. 6, of which a housing 104 is designed to be of a half-circle shape in cross-section, and the major light of the LEDs 120 will eventually travel downward after reflected by the housing 104. In this design, a frosted lampshade 134 is preferably used to prevent a dazzling phenomenon happening right below the lighting assembly.

Besides, there is another important parameter in the present invention—a distance h between the supporter 110 and the opening of the housing. When the distance h gets longer, much light will be blocked by the supporter 110; when the distance h gets shorter, less light will be blocked, but much of the light of the LEDs 120 will travel through the light output face without being reflected by the housing 104.

Figure 7:
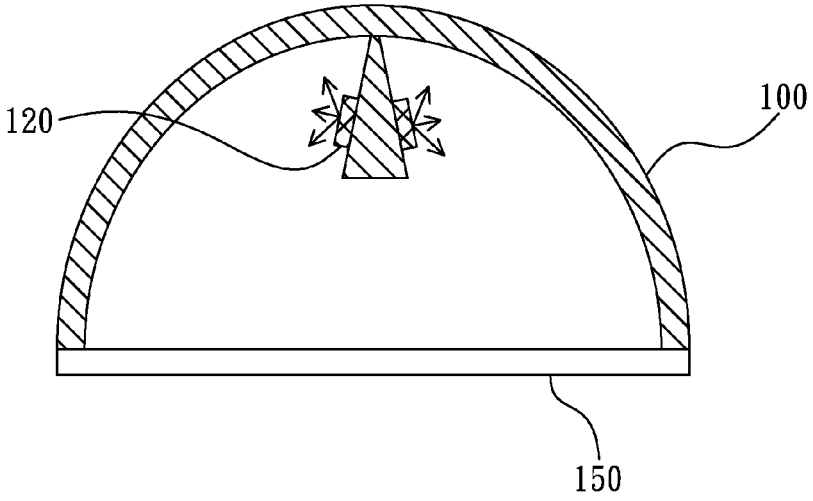
FIG. 7 illustrates a cross sectional view of a tube type LED lighting assembly according to another preferred embodiment of the present invention, wherein the tube type LED lighting assembly has a plane lampshade.

Please refer to FIG. 7, which illustrates a cross sectional view of a tube type LED lighting assembly according to another preferred embodiment of the present invention, wherein the tube type LED lighting assembly has a plane lampshade 150. In general, the plane lampshade 150 has a lower manufacturing cost and is capable of reducing the size of the lighting assembly to cut down transportation cost.

Figure 8:
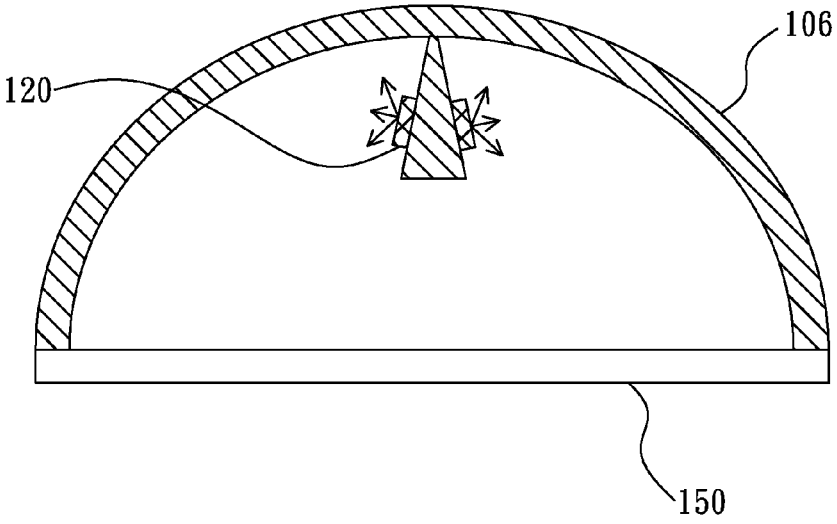
FIG. 8 illustrates a cross sectional view of a tube type LED lighting assembly according to another preferred embodiment of the present invention, wherein the tube type LED lighting assembly has a housing of another curved shape in cross-section.

Please refer to FIG. 8, which illustrates a cross sectional view of a tube type LED lighting assembly according to another preferred embodiment of the present invention, wherein the tube type LED lighting assembly has a housing 106 designed to have another curved shape in cross-section—an oval shape or a parabolic shape. The parabolic shape is capable of converting light of the LEDs 120 placed near the focus of the parabolic shape into parallel light. This can meet special light pattern requirements of some applications. In comparison, traditional lamp tubes use cathode rays to ignite mercury gas to generate white light, so the white light will travel in all directions around the tube, making it impossible for traditional lamp tubes to provide parallel light beams traveling downward in a single direction; while the present invention can provide different curved shapes of the housing for different light patterns required by different applications. In addition, as illustrated in FIG. 9, a housing 108 can also be designed to have a cross-sectional shape of a polygon—a pentagon shape or an octagon shape for example—formed by a plurality of line segments, and the polygon is intended to approach a curve.

Figure 9:
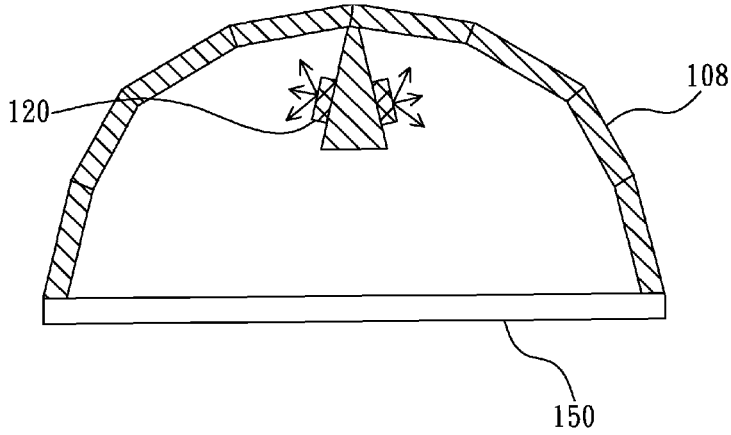
FIG. 9 illustrates a cross sectional view of a tube type LED lighting assembly according to another preferred embodiment of the present invention, wherein the tube type LED lighting assembly has a housing of a polygon shape in cross-section.

Alterations can be made on the embodiments of FIG. 8 and FIG. 9. For example, the inside surface of the housing can be of a curved shape or a polygon shape, and the outer surface of the housing can be of a half-circle shape to go with a half-circle lampshade.

Figure 10A:
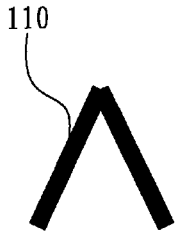
FIG. 10A illustrates a cross sectional view of a supporter of a tube type LED lighting assembly according to a preferred embodiment of the present invention, wherein the supporter is of V shape in cross-section.
Figure 10B:
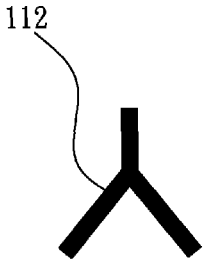
FIG. 10B illustrates a cross sectional view of a supporter of a tube type LED lighting assembly according to a preferred embodiment of the present invention, wherein the supporter is of Y shape in cross-section.
Figure 10C:
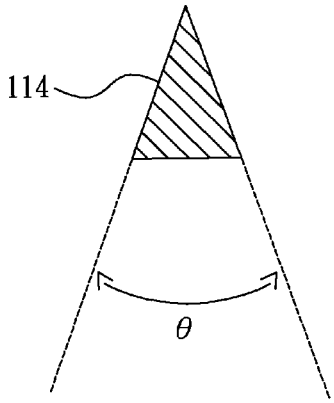
FIG. 10C illustrates a cross sectional view of a supporter of a tube type LED lighting assembly according to a preferred embodiment of the present invention, wherein the supporter is of a triangle shape in cross-section.
Figure 11:
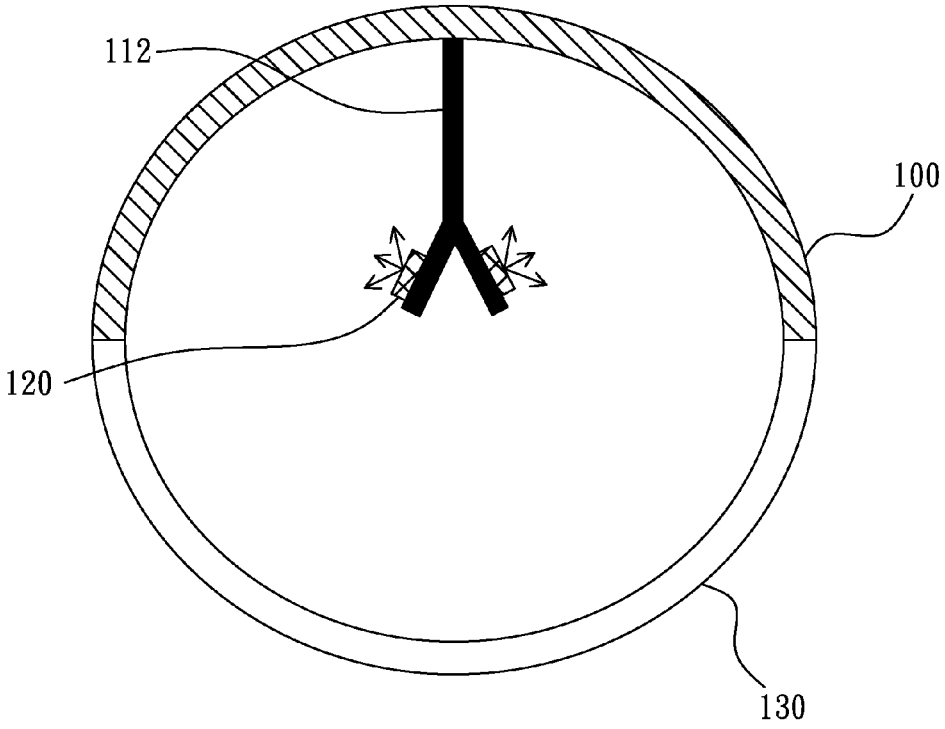
FIG. 11 illustrates a cross sectional view of a tube type LED lighting assembly according to still another preferred embodiment of the present invention.

Please refer to FIG. 10A-C, which illustrate different supporter structures. In the embodiments of FIG. 3-9, the supporter 110 is of V shape as illustrated in FIG. 10A. This shape makes the supporter 110 more simple and lighter. Another design, as illustrated in FIG. 10B, is a supporter of Y shape. Besides, the inside region of the supporter of V shape can be made solid to result in a supporter of a triangle shape as illustrated in FIG. 10C. No matter what shape is used, the supporter will have an angle θ formed between two faces, and the angle θ is crucial to the present invention. When the angle θ is larger, most of the light of the LEDs will be incident on the central region of the housing, causing more light traveling downward after reflection, and the lighting assembly will have higher directionality; When the angle θ is smaller, most of the light of the LEDs will be incident on the side regions of the housing, causing more side light, and the lighting assembly will have lower directionality. In addition to the angle θ, the supporter of Y shape has another parameter for adjusting the locations of the LEDs. As illustrated in FIG. 11, the locations of the LEDs 120 are disposed near the center of the housing 100 by the supporter 112 of Y shape having a corresponding vertical length.

In one embodiment, a fluorescent powder can be formed uniformly on the lampshade 130 of FIG. 3 to generate a light mixing effect with the LEDs 120. For example, a yellow fluorescent powder can be used to perform a light mixing with blue light LEDs to generate a white light source. The yellow fluorescent powder can be YAG (yttrium aluminum garnet), TAG (terbium aluminum garnet), or silicate, etc. Besides, the white light source can also be provided by using a fluorescent powder of multiple light colors to go with LEDs of a specific color. For example, a fluorescent powder of green light and red light can be used to go with LEDs of blue light, and a fluorescent powder of three primary colors can be used to go with LEDs of ultraviolet light to produce white light. Fluorescent powder of different light colors can be attained by mixing nitrides, sulfides, or silicates, etc.

The present invention has the advantages as follows:

First, as the present invention uses a one-time reflection mechanism instead of a frosted lampshade to make LED light uniform, therefore, the present invention can reduce light attenuation to provide illumination of high intensity.

Second, the supporter has two faces to form an angle for determining a light pattern to provide more downward light or more side light.

Third, the supporter can be of Y shape, having a vertical length for adjusting the locations of the LEDs to provide another dimension for determining a light pattern of the lighting assembly.

Finally, the cross section of the reflective surface of the housing can be of a circle shape, or a parabolic shape, or an oval shape, or other curved shapes, or a polygon shape to help determine a desired light pattern.

While the invention has been described by way of example and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance than the conventional structure and further complies with the patent application requirements and is submitted to the Patent and Trademark Office for review and granting of the commensurate patent rights.

What is claimed is:

1. An LED lighting assembly, comprising:

a housing, being a concave reflector;

a supporter, placed in a center region of said housing, said supporter having a first face and a second face, and an angle being formed between said first face and said second face;

two sets of LEDs, mounted on said first face and said second face for proving light to be reflected by said concave reflector to travel through a light output face; and a lampshade, which is connected with said housing;

wherein said housing and said lampshade combine to form a pillar shape.

2. The LED lighting assembly as claim 1, wherein said housing has an arc of an angle less than 180 degrees in cross section.

3. The LED lighting assembly as claim 2, wherein said lampshade has two frosted sections at two sides, and said two frosted sections and said housing combine to form a 180 degrees arc in cross section.

4. The LED lighting assembly as claim 1, wherein said lampshade is a plane transparent lampshade.

5. The LED lighting assembly as claim 4, wherein said housing has a half-circle or half-oval shape in cross section.

6. The LED lighting assembly as claim 1, wherein said housing has a cross-sectional shape of a polygon formed by a plurality of line segments, and said polygon approaches a curve.

7. The LED lighting assembly as claim 1, wherein said supporter has a cross-sectional shape of V or Y.

8. The LED lighting assembly as claim 1, wherein said lampshade has a fluorescent powder layer.

* * * * *